US006560343B1

(12) United States Patent
Kim

(10) Patent No.: US 6,560,343 B1
(45) Date of Patent: May 6, 2003

(54) SPEAKER SYSTEM

(75) Inventor: Jae-Nam Kim, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 1108 days.

(21) Appl. No.: 08/733,567

(22) Filed: Oct. 18, 1996

(30) Foreign Application Priority Data

Apr. 22, 1996 (KR) ..... 96-12217
Apr. 22, 1996 (KR) ..... 96-12219

(51) Int. Cl.[7] ..... H04R 25/00
(52) U.S. Cl. ..... 381/349; 181/156
(58) Field of Search ..... 381/156, 205; 181/152, 156, 177

(56) References Cited

U.S. PATENT DOCUMENTS 5,206,465 A * 4/1993 Jung ..... 181/152
5,604,337 A * 2/1997 Sugimoto et al. ..... 181/152

* cited by examiner

*Primary Examiner*—Sinh Tran
(74) *Attorney, Agent, or Firm*—Sughrue Mion, PLLC

(57) ABSTRACT

A speaker system includes a speaker having a cone which converts an electric signal into a sound wave signal; a frame attached to a rear side of the speaker and having a plurality of sound wave radiating holes formed therein; and a sound wave amplifying horn for amplifying and radiating only a portion of sound waves which are radiated through the frame.

11 Claims, 6 Drawing Sheets

SPEAKER SYSTEM

BACKGROUND OF THE INVENTION

1. Field of the Invention

The present invention relates to a speaker system for audio systems, televisions, or the like, and more particularly to a speaker system in which bass sounds discharged rearward to a speaker are amplified to improve bass quality.

2. Description of the Related Art

Generally, a speaker converts an electric signal into a sound wave signal and radiates the sound wave signal into free space. A cone speaker is the most frequently used conventional speaker. In a cone speaker, if a strong cylindrical magnetic field is created in a magnet which is located between a center pole and a yoke, as current is applied to a voice coil which is disposed in the magnetic field, force is induced to vibrate a conical vibrating board, made of paper for example, to thereby radiate sound waves.

Since the force is constant regardless of a frequency, it is possible to obtain flat frequency characteristics over a wide range of frequencies. The low frequency zone of the speaker system is restricted by a minimum resonance frequency that can be determined in a known manner by an equivalent mass including a radiation mass and a compliance due to edge, damper, etc. The high frequency zone is restricted by divided vibration due to a limit in the rigidity of a cone paper.

In divided vibration, since a small diameter of cone yields a higher frequency, speakers having the same structures and different cone diameters are used in combination to radiate sound waves having a wide range of frequencies.

In addition to the minimum resonance frequency, the low frequency zone radiation is influenced by the size of a cabinet containing the speaker. This is because when the cone is vibrated to radiate the sound waves, counter phases are generated in the forward and rearward directions of the cone and may interfere with each other, so that the sound waves are not properly radiated in the low frequency zone. Accordingly, in order to obtain sound waves of low frequency, the size of the cabinet must be somewhat large. This prevents an audio system, television, or the like, from being compact.

A speaker system for obtaining sound waves of low frequency without enlarging the size of a speaker cabinet is disclosed in the Korean patent publication No. 92-5066. FIG. 1 illustrates a cross-sectional view of the speaker system disclosed therein. The speaker system includes a speaker 2 which is disposed in a speaker housing 1 and has a diaphragm 2*a* for converting an electric signal into a sound wave signal; a sound wave collector 3 for collecting sound waves generated by the vibration of the diaphragm 2*a;* a wave guide 4 for transmitting the sound waves collected by the sound wave collector 3; and a horn 5 for radiating and amplifying the sound waves outputted from the wave guide 4. A tube 6 which is provided with an opening having the same diameter as the maximum diameter of the diaphragm 2*a,* is secured to a frame of the speaker 2 in one end thereof to integrate the sound wave collector 3 with the wave guide 4. The horn 5 is attached to the other end of the tube 6.

Referring now to FIG. 2 which illustrates a cross-sectional view of another conventional speaker system, a tube 6 which defines a wave guide 4 has a portion that runs parallel to a center axis of a moving coil to radiate sound waves and a portion that bends toward a horn 5 facing a forward space of a speaker system. Accordingly, the sound waves radiated toward a rear position of the housing 1 are amplified in the tube 6 while passing through a sound wave collector 3 and the wave guide 4, and thereafter are radiated through the horn 5 toward the front of the housing 1.

However, the conventional speaker systems constructed as mentioned above suffer from drawbacks in that although a portion of the bass sound waves radiated rearward of the speaker can be amplified to some extent, since the sound waves radiated rearward of the speaker are totally transmitted through the wave guide 4 and the horn 5, serious interference occurs between the sound waves radiated rearward of the speaker that have a frequency lower than a desired level. Particularly, bass of a very low level can not be properly amplified and clearness of the resulting sound is severely deteriorated due to compression of the sound waves. Also, because the wave guide 4 and the horn 5 must collect all the sound waves radiated rearward of the speaker, the sizes of the wave guide 4 and the horn 5 are large, which results in enlargement in the size of the speaker housing. Accordingly, it is difficult for the speaker system to be applied to audio systems, televisions, or the like, which are compact. Moreover, when molding a one-piece tube which has a geometric configuration, the size of a mold must be large, which in turn increases overall manufacturing costs.

SUMMARY OF THE INVENTION

Accordingly, the present invention has been made in an effort to solve the above problems occurring in the prior art, and an object of the present invention is to provide a speaker system which collects and amplifies only a portion of sound waves which are radiated rearward of a speaker to increase bass sound amplification efficiency and to ensure clearness of the resulting sound.

Another object of the present invention is to provide a speaker system which is small and light-weight.

Still another object of the present invention is to provide a speaker system in which a sound wave amplifying horn for amplifying sound waves is assembled from pieces in a detachable manner, to ease manufacturing operation and to reduce costs thereof.

According to one aspect of the present invention, there is provided a speaker system comprising: a speaker having a cone which converts an electric signal into a sound wave signal; a frame attached to a rear side of the speaker and having a plurality of sound wave radiating holes formed therein; and a sound wave amplifying horn for amplifying and radiating only a portion of sound waves which are radiated rearward of the frame.

According to another aspect of the present invention, the sound wave amplifying horn collects and amplifies sound waves radiated through at least one of the sound wave radiating holes.

According to another aspect of the present invention, the sound wave amplifying horn includes a plurality of sound collecting parts which collect sound waves radiated through the sound wave radiating holes, and an amplifying part which amplifies sound waves collected in the sound wave collecting parts.

According to another aspect of the present invention, a minimum diameter of the amplifying part is equal to the sum of diameters of the sound wave collecting parts.

According to another aspect of the present invention, an echo opening is formed in a housing for the speaker to discharge sound waves which are not collected in the sound wave amplifying horn.

According to another aspect of the present invention, the sound wave amplifying horn includes a first amplifying member which has a gradually increasing diameter, and a second amplifying member which is detachably assembled to the first amplifying member.

According to another aspect of the present invention, the sound wave amplifying horn includes a discharging horn formed in one end thereof to discharge amplified sound waves.

According to another aspect of the present invention, the first amplifying member includes a sound wave collecting part which collects only a portion of the sound waves radiated through the sound wave radiating holes.

According to another aspect of the present invention, the first amplifying member includes a plurality of engaging grooves formed on both sides thereof, and the second amplifying member includes a plurality of engaging protrusions fitted in the engaging grooves respectively.

According to another aspect of the present invention, the first amplifying member includes a plurality of guide holes formed on both sides thereof, and the second amplifying member includes a plurality of guide pins inserted into the guide holes.

According to still another aspect of the present invention, at least one of the first and second amplifying members has an elastic grip for holding electric wires.

The speaker systems according to the present invention provide advantages in that, since only a portion of sound waves which are radiated rearward of a speaker are collected and amplified, reflected waves or standing waves will not be generated in a sound wave amplifying horn. This increases amplification efficiency of bass sounds to improve clearness of sounds. Also, since design and manufacturing of the speaker can be performed easily and the size of the speaker can be reduced, the speaker can be applied to compact audio systems and televisions. Further, since the sound wave amplifying horn is detachably assembled, overall manufacturing costs can be reduced and the assembling operation can be carried out in a convenient manner.

BRIEF DESCRIPTION OF THE DRAWINGS

The above objects, and other features and advantages of the present invention will become more apparent through the following detailed description taken in conjunction with the drawings, in which.

DETAILED DESCRIPTION OF THE PREFERRED EMBODIMENTS

Figure 1:
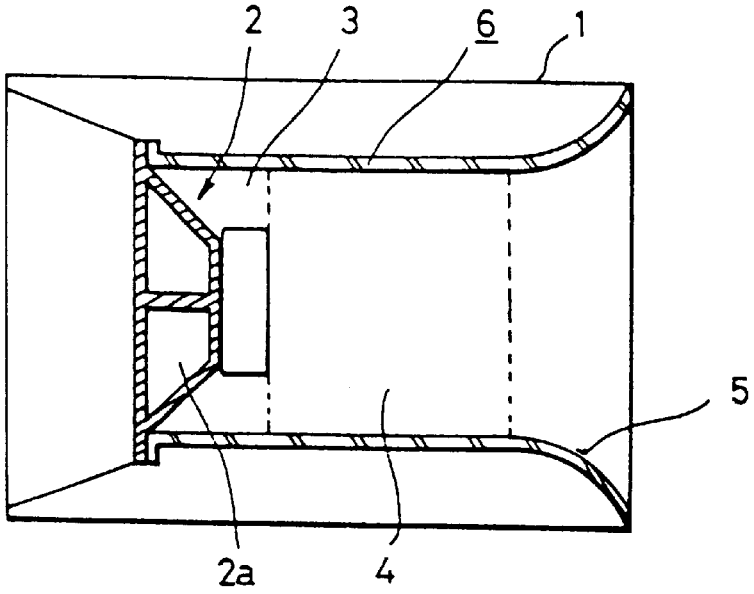
FIG.1(Prior Art)
FIG. 1 is a cross-sectional view of a conventional speaker system.
Figure 2:
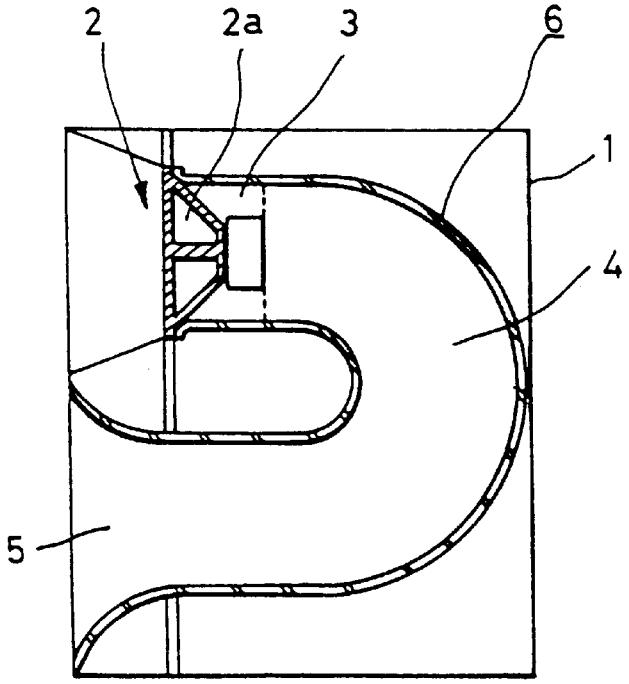
FIG.2(Prior Art)
FIG. 2 is a cross-sectional view of another conventional speaker system.
Figure 4:
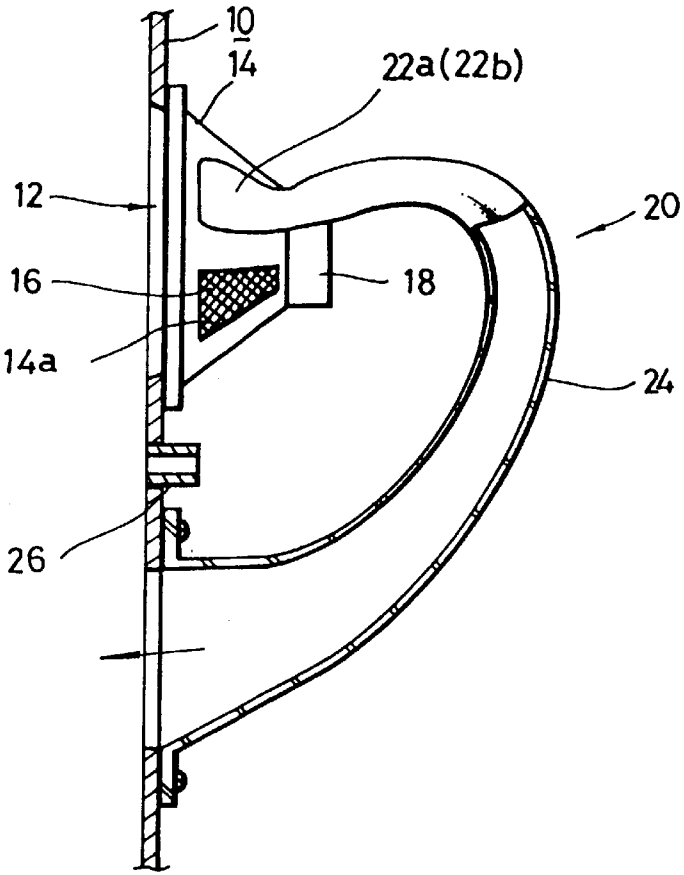
FIG. 4 is a cross-sectional view of the speaker system of FIG. 3.
Figure 3:
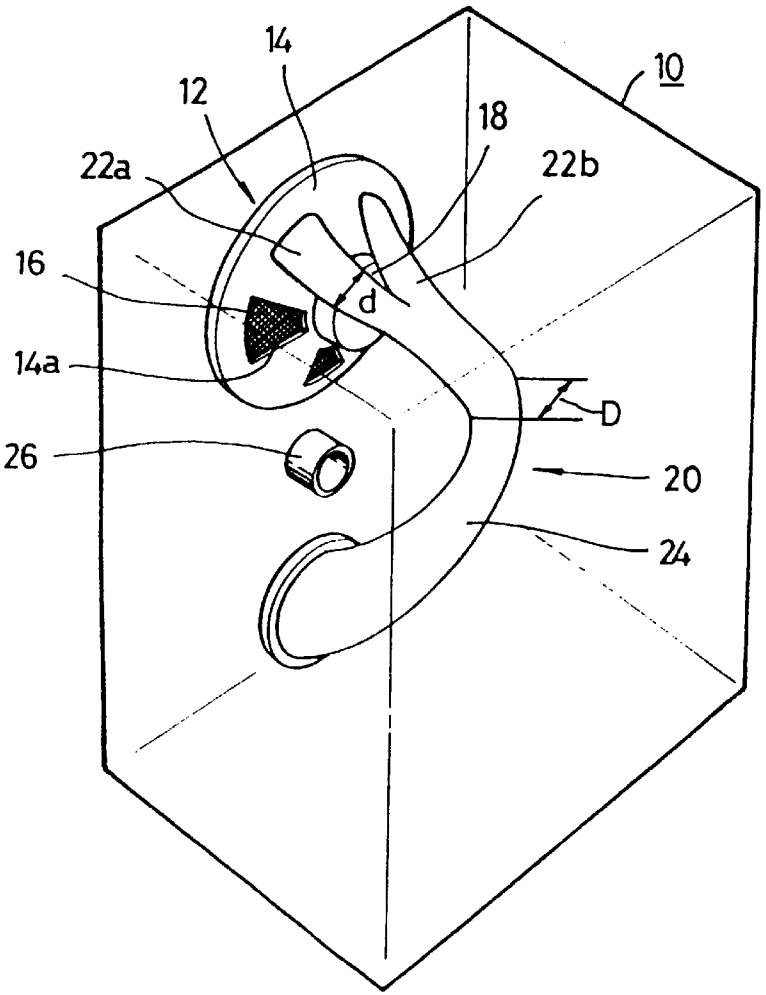
FIG. 3 is a perspective view of a speaker system in accordance with an embodiment of the present invention.

FIGS. 3 and 4 illustrate a speaker system according to a first embodiment of the present invention. A speaker 12 is mounted to the inside surface of the front wall of a speaker cabinet 10. The speaker 12 includes a frame 14, a cone 16 and a magnet 18. The frame 14 has a frusto-conically shaped configuration and has a plurality of sound wave radiating holes 14*a* formed therein. The cone 16 is attached to the inside surface of the frame 14 to cover the sound wave radiating holes 14*a,* and the magnet 18 is fastened to the rear end of the frame 14. A sound wave amplifying horn 20 is fixed to the side surface of the frame 14 to collect and amplify only a portion of the sound waves which are radiated through the plurality of sound wave radiating holes 14*a*. In this embodiment of the present invention, there are four sound wave radiating holes 14*a*.

The sound wave amplifying horn 20 includes sound wave collecting parts 22*a* and 22*b* which collect sound waves radiated from at least two of the four sound wave radiating holes 14*a,* and a sound wave amplifying part 24 which amplifies the sound waves passed through the sound wave collecting parts 22*a* and 22*b* and discharges the amplified waves outside of the speaker cabinet 10. It is preferable that the diameter of the sound wave amplifying part 24 be increased toward the discharging end thereof to afford easy amplification of the sound waves. Also, it is preferable that the minimum diameter D of the sound wave amplifying part 24 be equal to the sum of diameters of the sound wave collecting parts 22*a* and 22*b*.

Figure 5:
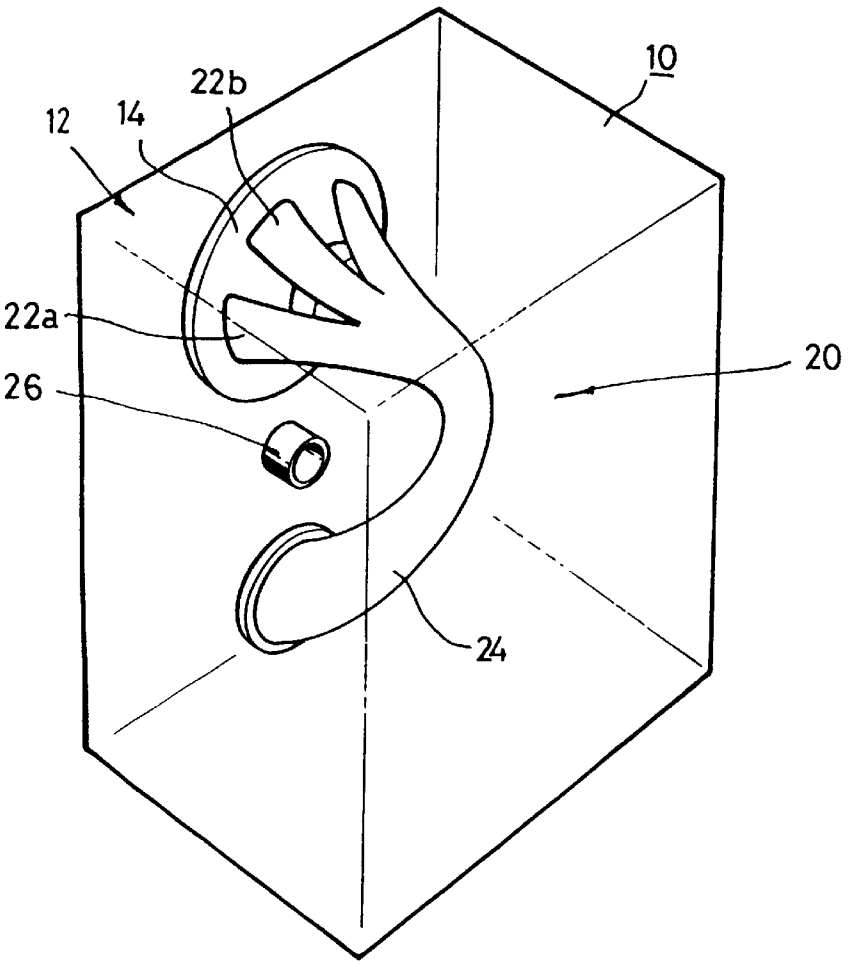
FIG. 5 is a perspective view of a speaker system in accordance with another embodiment of the present invention.
Figure 7:
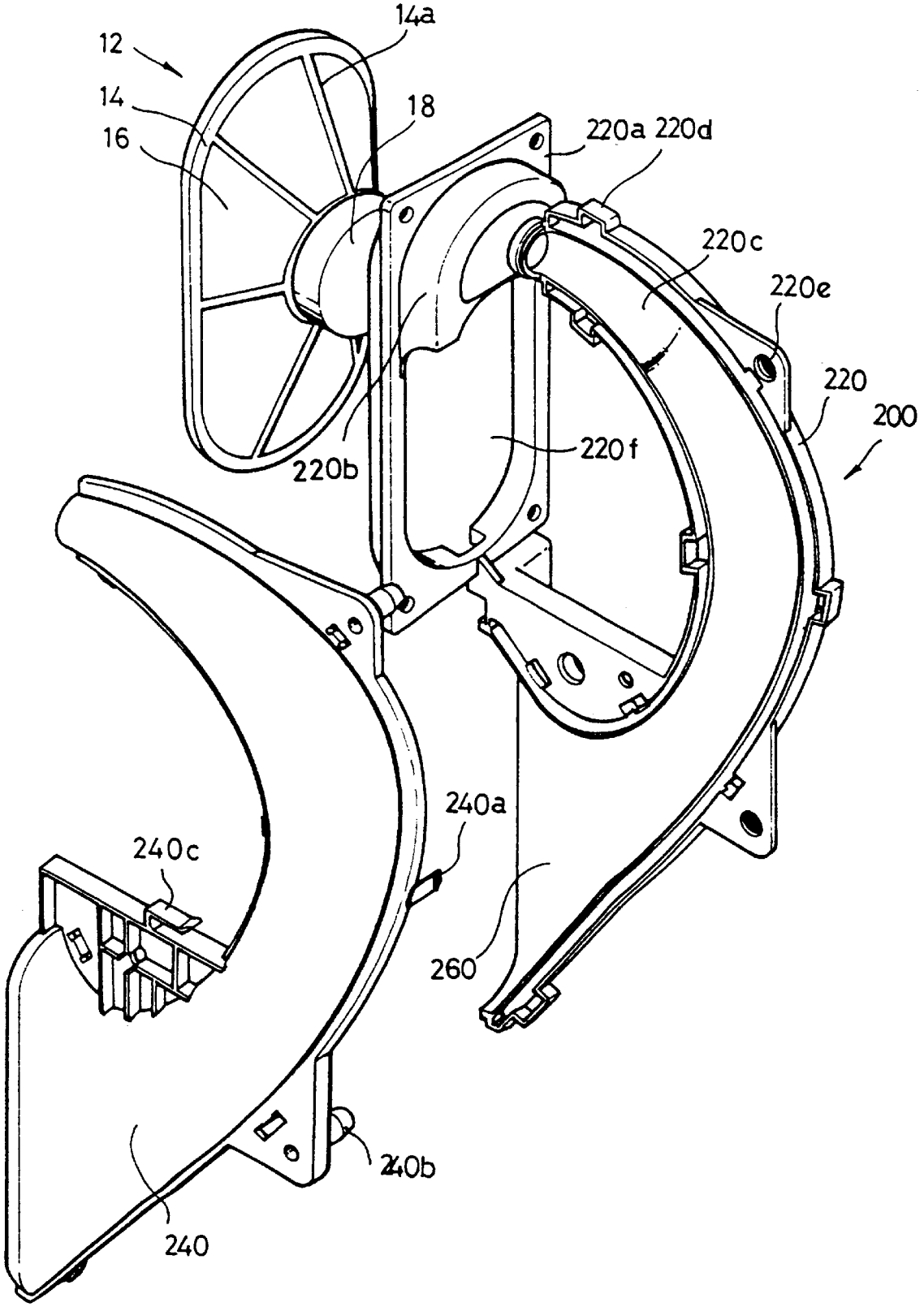
FIG. 7 is an exploded perspective view of a speaker system in accordance with still another embodiment of the present invention.
Figure 8:
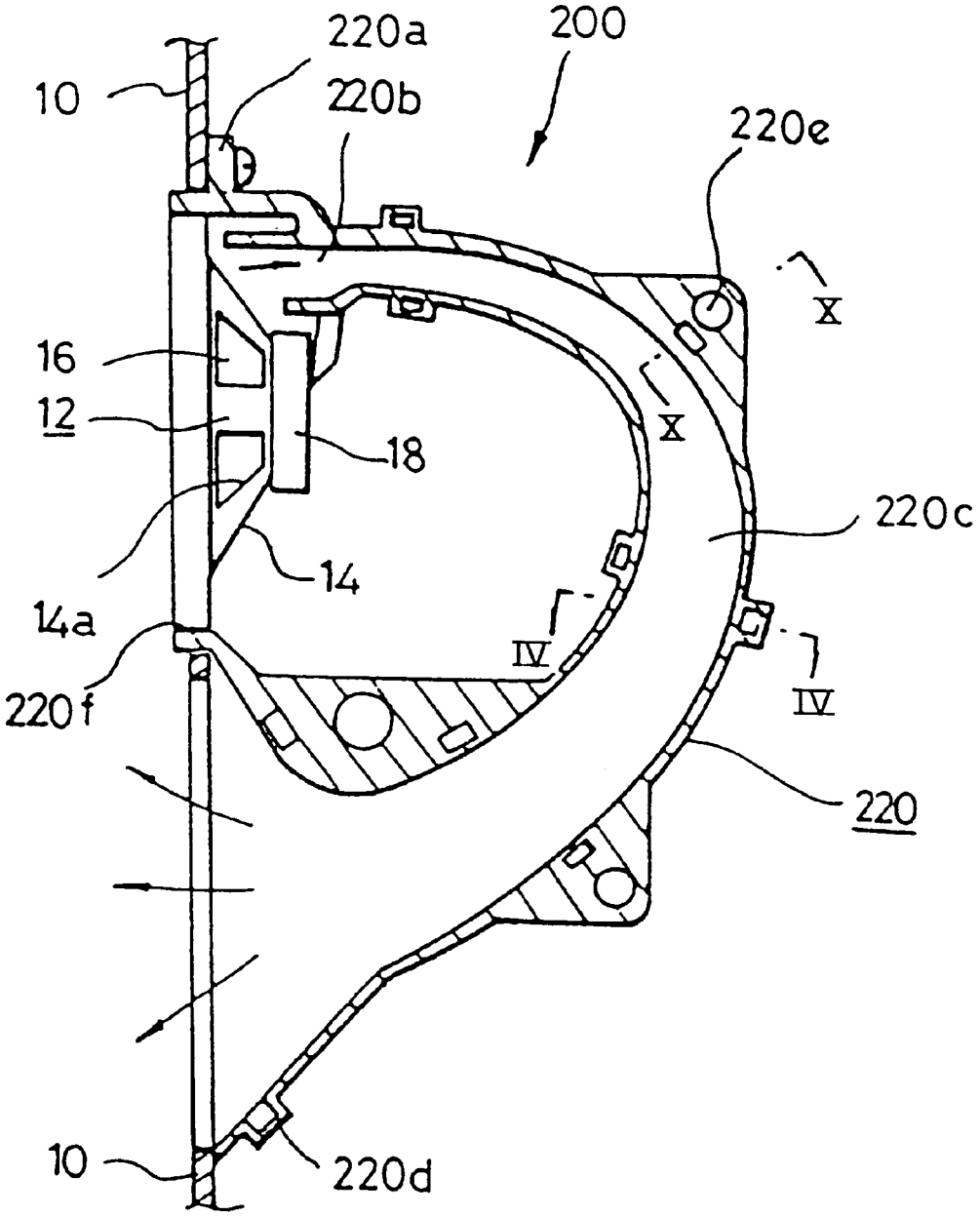
FIG. 8 is a cross-sectional view of the speaker system of FIG. 7.

The number of sound wave collecting parts 22*a* and 22*b* is not limited to two as shown in FIGS. 3 and 4, which is equal to half of the number of the sound wave radiating holes 14*a* formed in the frame 14. Only one sound wave collecting part can be formed, or, as shown in FIG. 5, sound wave collecting parts having a number corresponding to ¾ of the number of sound wave radiating holes 14*a* can be used, making a total of three sound wave collecting parts. Each sound wave collecting part collects and amplifies sound waves radiated through one of the sound wave radiating hole 14*a*. Any fraction of sound wave radiating holes 14*a* can have a sound wave collecting part coupled therewith.

In order to prevent noise from being generated due to vibration of components other than the cone by sound waves radiated from the speaker 12, one end of the sound wave amplifying horn 20 which defines the sound wave collecting parts 22*a* and 22*b* is fixed to the frame 14 in a manner that the sound wave radiating holes 14*a* are closed, and the other end of the sound wave amplifying horn 20 is fixed to the inside surface of the front wall of the speaker cabinet 10. On the front wall of the speaker cabinet 10, an echo opening 26 is formed to discharge sound waves not collected by the sound wave amplifying horn 20.

In the speaker system constructed as noted above, if the cone 16 vibrates and generates sound waves by a strong cylindrical magnetic field created in the magnet 18, these sound waves are radiated not only forward but also rearward of the speaker 12. A portion of the sound waves which are radiated rearward of the speaker 12 is introduced into the cabinet 10 through the plurality of sound wave radiating holes 14*a* formed in the frame 14. A portion of the sound waves which are radiated through the sound wave radiating holes 14*a,* is directed into the sound wave amplifying horn 20, is amplified therein and then is discharged out forward of the speaker cabinet 10.

Specifically, after the portion of the sound waves is radiated through the sound wave radiating holes 14*a,* it is collected in each of the sound wave collecting parts 22*a* and 22*b.* While passing through the amplifying part 24 which has a gradually increasing diameter, the sound waves are sufficiently amplified and then discharged out of the front of the speaker cabinet 10. By this, amplification efficiency of the sound waves, particularly of the bass sounds, which are radiated through the sound wave amplifying horn 20, is increased and thus the clearness of the resulting sound is improved. Also, because the minimum diameter D of the amplifying part 24 is equal to the sum of diameters of the sound wave collecting parts 22*a* and 22*b,* the sound waves which are channelled through the sound collecting parts 22*a* and 22*b* into the amplifying part 24, do not experience the problem of interference or reflection between the sound waves. This prevents some sound waves from flowing back toward the speaker 12. Accordingly, the cone 16 will not be affected by reflected waves, and interference by standing waves is prevented.

Figure 6:
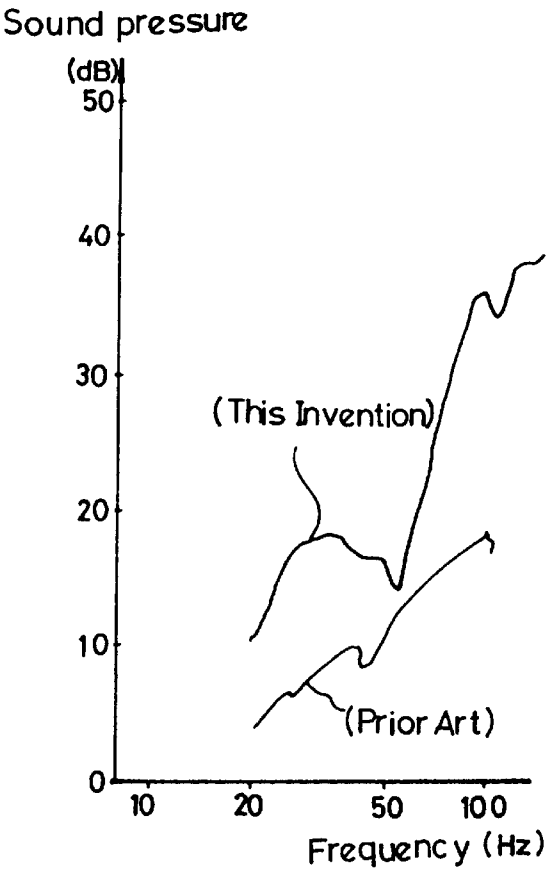
FIG. 6 is a graph showing frequency characteristics of the speaker systems of the preferred embodiments and the prior art.

Moreover, since the sound waves which are not directed into the sound wave amplifying horn 20 are radiated into the space in the speaker cabinet 10 and then discharged out of the front of the cabinet 10 through the echo opening 26, distortion due to interference of the sound waves is prevented, and thus clearness of the resulting sound is improved. Furthermore, because only a portion of the sound waves which are radiated rearward of the speaker 12 is collected and amplified, low-zone frequency is markedly increased when compared to prior art devices, as shown in FIG. 6 which is a graph of sound pressure versus frequency.

FIGS. 7 through 10 illustrate a speaker system in accordance with another embodiment of the present invention. In FIGS. 7 through 10, parts which are identical with those of FIGS. 3 through 5, are represented by the same reference numerals. According to this embodiment, an amplifying horn 200 is mounted to the inside surface of the front wall of a speaker cabinet 10 to collect and amplify only a portion of sound waves which are radiated through a plurality of sound wave radiating holes 14*a* formed in the side wall of a frame 14.

The sound wave amplifying horn 200 includes a first amplifying member 220, and a second amplifying member 240 which is detachably engaged with the first amplifying member 220. The first and second amplifying members 220 and 240 cooperate with each other to collect and amplify a portion of the sound waves which are radiated rearward of a speaker 12.

The first amplifying member 220 includes a mounting part 220*a* which is mounted to the inner surface of the front wall of the speaker cabinet 10; a sound wave collecting part 220*b* which collects only a portion of the sound waves radiated through the sound wave radiating holes 14*a;* an amplifying part 220*c* which has a gradually increasing diameter to amplify the sound waves directed thereinto; and a plurality of engaging grooves 220*d* and guide holes 220*e* which are formed in both sides of the amplifying part 220*c*. One end of the first amplifying member 220 is formed with an opening 220*f* through which the sound waves not collected by the sound wave collecting part 220*b* can pass.

Figure 9:
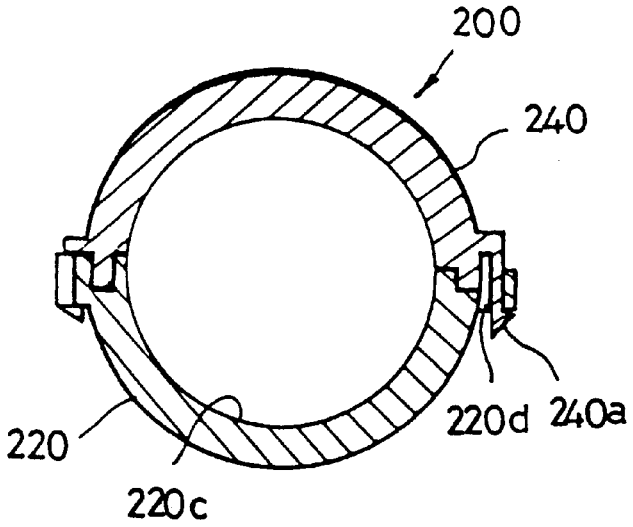
FIG. 9 is a cross-sectional view taken along the line IX—IX of FIG. 8.
Figure 10:
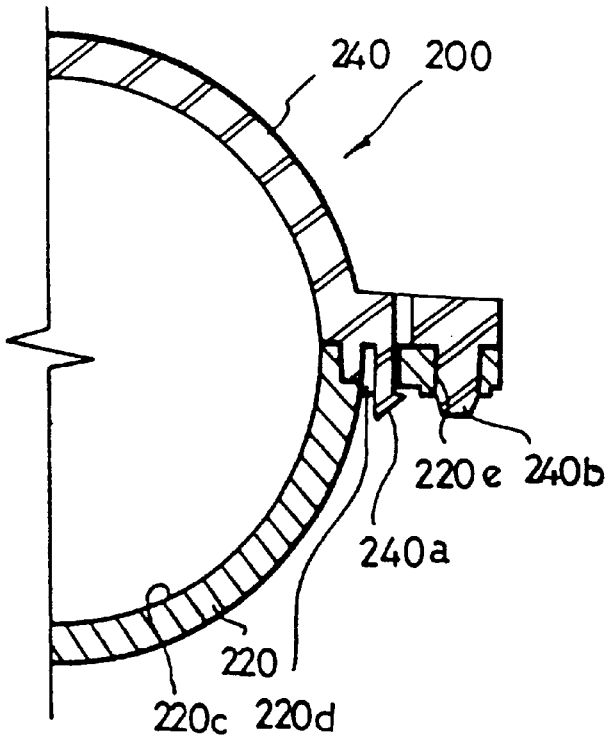
FIG. 10 is a cross-sectional view taken along the line X—X of FIG. 8.

The second amplifying member 240 has generally the same configuration with the first amplifying member 220. As best shown in FIGS. 9 and 10, on both sides of the second amplifying member 240 there are a plurality of engaging projections 240*a* which are engaged in the engaging grooves 220*d,* respectively, and a plurality of guide pins 240*b* which are inserted into the guide holes 220*e,* respectively. By the above structure, the first and second amplifying members 220 and 240 are securely fastened to each other. An elastic grip 240*c* capable of holding an electric wire, or the like, is provided in the second amplifying member 240.

The end of the sound wave amplifying horn 200, which is opposite to the opening 220*a,* is formed with a discharging horn 260. The discharging horn 260 discharges the sound waves forward of the speaker cabinet 10, which is redirected into the sound wave collecting part 220*b* and amplified in the amplifying part 220*c*.

In the speaker system according to this embodiment of the present invention, if a cone 16 vibrates and generates sound waves by a strong cylindrical magnetic field created in a magnet 18, these sound waves are radiated not only forward but also rearward of the speaker 12. A portion of the sound waves which are radiated rearward of the speaker 12, is introduced into the speaker cabinet 10 through the plurality of sound wave radiating holes 14*a* formed in the side surface of the frame 14. At this time, a portion of the sound waves which are radiated through the sound wave radiating holes 14*a,* is directed into the sound wave amplifying horn 200, amplified therein and then discharged out of a front of the speaker cabinet 10.

Specifically, after a portion of the sound waves is radiated through the sound wave radiating holes 14*a,* it is collected in the sound wave collecting part 220*b*. While passing through the amplifying part 220*c* which has a gradually increasing diameter, the sound waves are sufficiently amplified and then radiated forward of the speaker cabinet 10 through the discharging horn 260. By this, amplification efficiency of the sound waves, particularly of the bass sounds, which are discharged through the discharging horn 260, is increased, thus improving clearness of the resulting sound.

Also, because a plurality of engaging projections 240*a* and guide pins 240*b* formed in the second amplifying member 240 are engaged and inserted respectively into a plurality of engaging grooves 220*d* and guide holes 220*e* formed in the first amplifying member 220, the first and second amplifying members 220 and 240 are securely fastened to each other and the assembling/disassembling operations can be performed easily. Furthermore, because the first and second amplifying members 220 and 240 are each separately manufactured, the size of the mold used for molding the parts can be decreased to reduce overall manufacturing costs. Moreover, since only a portion of the sound waves which are radiated rearward of the speaker is collected and amplified, the size of the sound wave amplifying horn 200 can be reduced to allow application thereof to audio systems, televisions, or the like, which are compact.

As a result, the speaker systems according to the present invention provide advantages in that since only a portion of sound waves which are radiated rearward of a speaker is collected and amplified, reflected waves or standing waves will not be generated in a sound wave amplifying horn to increase amplification efficiency of bass sounds and improve the clearness of the resulting sounds. Also, since design and manufacturing of the speaker can be easily performed and the size of the speaker can be reduced, the speaker can be applied to compact audio systems, televisions, or the like, and since the sound wave amplifying horn is detachably assembled from parts, overall manufacturing costs can be reduced and the assembling operation can be carried out easily.

The invention has been described through preferred embodiments. However, various modifications can be made without departing from the scope of the invention as set forth in the following claims.

What is claimed is:

1. A speaker system comprising:

a speaker having a cone which converts an electric signal into a sound wave signal;

a frame attached to a rear side of said speaker and having a plurality of sound wave radiating holes formed therein; and a sound wave amplifying horn for amplifying and radiating only a portion of sound waves which are radiated from the rear side through said frame.

2. A speaker system as claimed in claim 1, wherein said sound wave amplifying horn is coupled to at least one of said sound wave radiating holes to collect and amplify sound waves radiated through said at least one of said sound wave radiating holes.

3. A speaker system as claimed in claim 1, wherein said sound wave amplifying horn includes a plurality of sound collecting parts which are coupled to said sound wave radiating holes to collect sound waves radiated through said sound wave radiating holes, and an amplifying part which amplifies sound waves collected in said sound wave collecting parts.

4. A speaker system as claimed in claim 3, wherein a minimum diameter of said amplifying part is equal to the sum of diameters of said sound wave collecting parts.

5. A speaker system as claimed in claim 1, further comprising a housing for containing said speaker, an echo opening being formed in said housing to discharge sound waves which are not collected in said sound wave amplifying horn.

6. A speaker system as claimed in claim 1, wherein said sound wave amplifying horn includes a first amplifying member which has a gradually increasing diameter, and a second amplifying member which is detachably assembled to said first amplifying member.

7. A speaker system as claimed in claim 6, wherein said sound wave amplifying horn includes a discharging horn formed in one end thereof to discharge sound waves therefrom.

8. A speaker system as claimed in claim 6, wherein said first amplifying member includes a sound wave collecting part coupled to at least one of said sound wave radiating holes to collect only a portion of said sound waves radiated through said sound wave radiating holes.

9. A speaker system as claimed in claim 6, wherein said first amplifying member includes a plurality of engaging grooves formed on both sides thereof, and said second amplifying member includes a plurality of engaging protrusions engaged in said engaging grooves.

10. A speaker system as claimed in claim 6, wherein said first amplifying member includes a plurality of guide holes formed on both sides thereof, and said second amplifying member includes a plurality of guide pins inserted into said guide holes.

11. A speaker system as claimed in claim 6, wherein at least one of said first and second amplifying members has an elastic grip adapted to hold electric wires.

* * * * *